United States Patent [19]

Coble

[11] Patent Number: 4,843,653

[45] Date of Patent: Jul. 4, 1989

[54] MOISTURE ABSORBENT WRISTBAND

[76] Inventor: Terry G. Coble, P.O. Box 310, Alamance, N.C. 27201

[21] Appl. No.: 158,312

[22] Filed: Feb. 22, 1988

[51] Int. Cl.[4] ..... A41D 19/00/13/08

[52] U.S. Cl. ..... 2/170; 2/59; 2/162; 2/169

[58] Field of Search ..... 2/59, 162, 170, DIG. 11; 66/169 R, 172 R, 174, 201

[56] References Cited

U.S. PATENT DOCUMENTS

| | | | |
|---|---|---|---|
| 410,600 | 9/1889 | Mills | 2/59 |
| 570,694 | 11/1896 | Bennett et al. | 2/59 |
| 963,864 | 7/1910 | Carter | 2/59 |
| 1,941,508 | 1/1934 | Zwicker | 66/174 |
| 2,249,550 | 7/1941 | Williams | 2/170 |
| 2,260,118 | 10/1941 | Marr | 66/201 |
| 2,643,389 | 6/1953 | Wegner | 2/170 |
| 2,778,027 | 1/1957 | Bacon | 2/170 |
| 2,836,828 | 6/1958 | Henrikson | 2/170 |
| 2,881,603 | 4/1959 | Vendetti | 66/172 R |
| 2,942,442 | 6/1960 | Michael-Lohs | 66/174 |
| 3,142,164 | 7/1964 | Merritt | 66/201 |
| 3,184,758 | 5/1965 | Hirsh | 2/DIG. 11 |
| 4,517,685 | 5/1985 | Lesley | 2/170 |

*Primary Examiner*—Werner H. Schroeder
*Assistant Examiner*—Jeanette E. Champman
*Attorney, Agent, or Firm*—Rhodes & Coats

[57] ABSTRACT

A knitted tubular towel-like band worn around the wrist and lower arm during participation in various sports. Plain knit, relatively narrow welts fit snugly around the wrist and arm to hold a center, relatively wide terry knit portion in place over the lower arm and wrist. The terry knit portion serves both as a wristband to keep the hands dry and as a towel for blotting and absorbing perspiration from the face and forehead during play.

14 Claims, 2 Drawing Sheets

MOISTURE ABSORBENT WRISTBAND

BACKGROUND AND SUMMARY OF THE PRESENT INVENTION

The present invention is related to athletic sweatbands and more specifically to those which are worn on the wrist during participation in a variety of sports. Most known wristbands, or "sweatbands" as they are frequently called, are no more than one to two inches in width and are worn around the wrist or head to "catch" and keep the hands or areas around the eyes dry by absorbing perspiration. Such bands are generally made of a terry-knit cloth with an elastic or stretch material woven or otherwise encased therein.

Another approach is disclosed in U.S. Pat. No. 2,836,828 which is directed to a mitten-type article wherein the band extends not only over the wrist, but also over the upper hand and one thumb. A modification similar to that type of article is marketed under the trademark "Wristowel TM" by Bri-Tel Design, Inc. of Toronto, Ontario, Canada. The Bri-Tel article also is a loose fitting, mitten-type band which includes a terry construction throughout, is worn bunched around the wrist during play, and is pulled up over the hand only when needed as a towel. A primary problem with such styles is that the article can interfere with gripping a game racket, or generally be an annoyance if it gathers and slips around the wrist and hand when not in use. Also it is not easy to use the band to wipe the forehead without stopping to pull the band down over the hand.

Nothing is known to exist in the prior art to eliminate both the need for a towel and a wristband, immediately at hand as needed and to be worn without interference with play or gripping action.

The present invention is a unique approach to an athletic "sweatband," providing both a wristband to absorb perspiration and a terry-knit, towel-like portion of increased surface area used for blotting. The article further includes plain-knit, relatively snug welt areas which hold the terry portion in place, and which also provide a surface for the knitting in, printing, or other application of an ornamental decorative area or other indicia.

The tubular construction of the novel wristband includes a stretchable, plain-knit welt on each walewise edge of a center portion of terry knit construction of approximately three to five inches in width. The center portion serves as the towel or blotting surface and, when not in use, remains loosely extended around the arm, yet held in place by the plain knit welts which fit relatively snugly in place around the wrist and mid section of the lower arm. Preferred fibers used in constructing the band are 100% cotton because of its durability and absorbency; but, cotton/nylon, cotton/acrylic, or many other such blends of natural or manmade fibers can be used. Elastic material is incorporated in the welts to improve stretchability and a snug fit on the wearer.

Also incorporated in the welts is optional written indicia or ornamental designs which can be knitted in during construction, or which can be applied to the surface by printing, dyeing, or any of several known methods of application. As mentioned above, the welts are knitted in a plain stitch to facilitate the application of design indicia.

Other advantages and modification will become apparent as the following detailed description is studied in conjunction with the accompanying drawings.

In the drawings

DETAILED DESCRIPTION OF A PREFERRED EMBODIMENT

Figure 1:
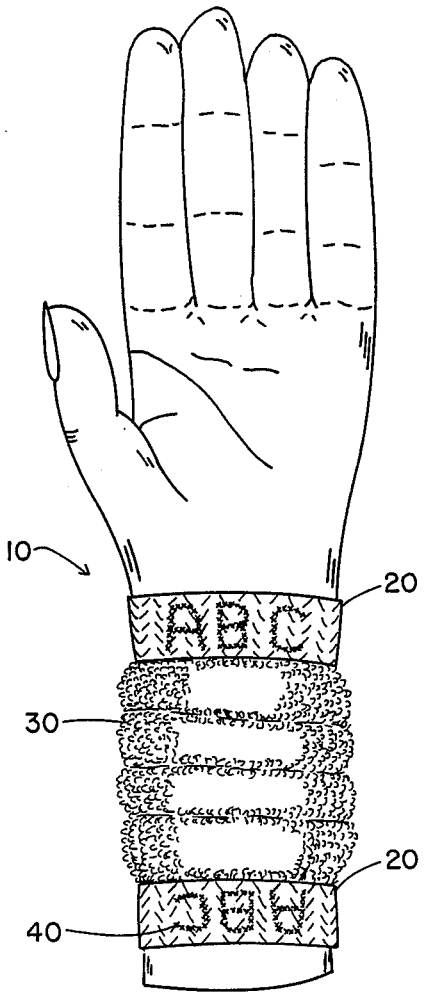
FIG. 1 is a perspective view of the wristband illustrating one way the band can be worn during normal play.
Figure 2:
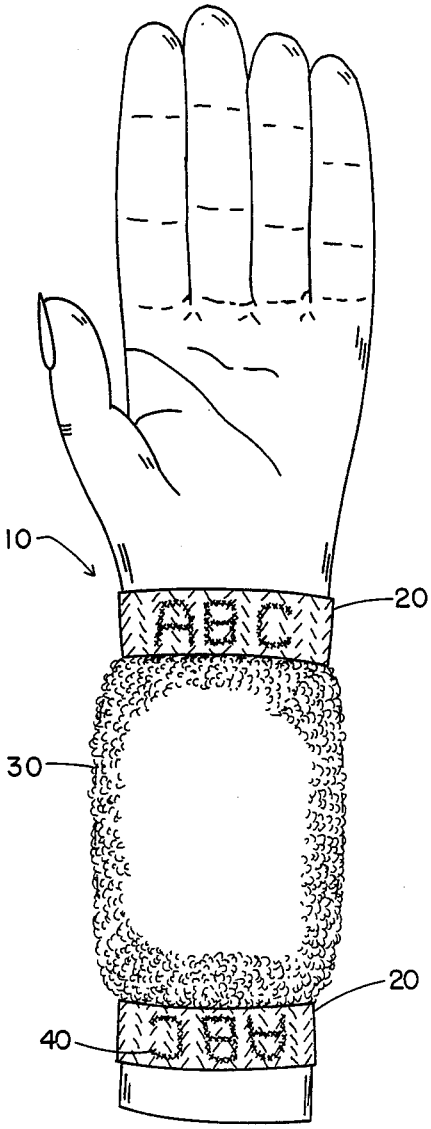
FIG. 2 is a perspective view of the wristband of FIG. 1 illustrating another way it can be worn during play and as it appears when extended over the lower arm and wrist area for use as a towel.
Figure 3:
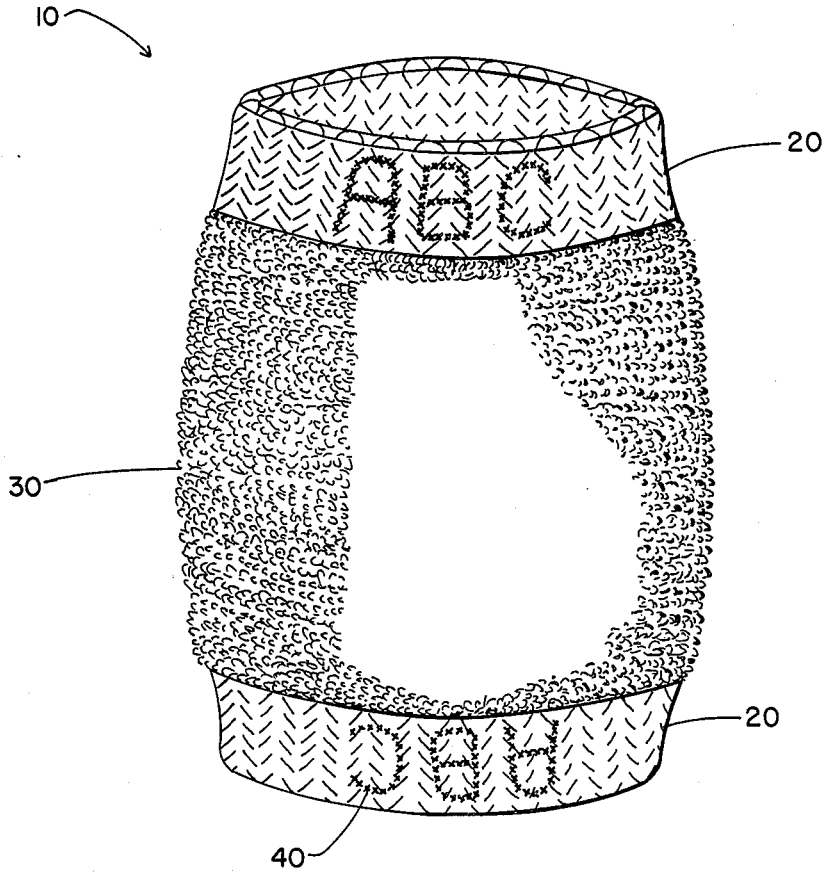
FIG. 3 is a view of the wristband according to a preferred embodiment, illustrating the relative sizes and textures of the welt and center areas.

Each of FIGS. 1 through 3 illustrates the preferred embodiment of the present invention 10 which is a tubular knit article adapted to be worn around the wrist. The article 10 generally comprises a welt portion 20 on either side of a center, predominant region 30 which is the more absorbent portion of the article The tubular band 10 is knit on a circular knitting machine of the type which permits selected courses to be plain knit and selected courses to be terry knit, to the completion of a seamless tubular article of desired circumference and length. In one embodiment the tubular band 10 is shed from the needles in a completed state; and in another, preferred embodiment each of the welts 20 is folded in half and stitched in place to make a double-thickness welt after the band comes off the knitting machine.

In construction of the preferred embodiment a first welt 20 is knitted, using a plain knit stitch, and having a length of approximately thirty to thirty-five courses. At the completion of the desired number of courses comprising the first welt, the terry needles are activated to knit the central predominant region 30 which is the towel-like portion used for blotting perspiration in the manner of the towels normally carried or kept conveniently nearby during play. The central portion 30 is preferably in the range of sixty to sixty-five courses in length, with each course being completed in the terry knit stitch. On completion of the desired terry courses in central portion 30, a second welt 20 is completed in plain knit, equal in length to the first welt.

When the completed tubular article 10 comes off the knitting machine, the welts 20 are each folded in half, toward the inside of the band 10, and stitched into place to form the double thickness welt. The stitching is completed in conventional fashion by a sewing machine. So completed, the finished, doubled welts 20 in plain knit are approximately fifteen to eighteen courses long, formed on each end of the central terry knit portion.

The knitting yarns which are employed may be of 100% cotton, cotton/synthetic, or other combinations of natural or synthetic yarn blends. One hundred percent cotton yarn provides the greater absorbency and durability, but any desired blend of natural and/or synthetics fiber yarn is satisfactory. With any selection of body yarn, it frequently proves desirable to lay in or knit in a spandex or other elastic yarn in the welts 20 to improve the stretch fit. Although the plain knit stitch will provide some stretch, the introduction of an elastic yarn will substantially improve fit and performance of the welt portions 20.

In the illustrations the indicia 40 on the welts 20 is knitted in and represents a logo, trademark, name, or ornamental indicia. As previously explained, the indicia 40 can be knitted in or printed or stamped on the surface. With the welt portions available for such indicia, the band 10 is an advance over prior known bands which are not receptive to such.

As explained above, the preferred way to wear the band or towel is extended over the lower arm from approximately the wrist to the lower arm. However, it is recognized that such wear is a matter of choice and some may prefer to crush the towel portion around the wrist rather than to expand it around the arm. Either approach is appropriate and depends entirely upon the wearer's choice. It is further recognized that other modifications and embodiments of the improved wristband are contemplated, the invention being limited only by the scope of the claims below.

What is claimed is:

1. A knitted, tubular, towel-like article adapted to be worn around the wrist during participation in a variety of different sports and used for absorbing moisture from the arm, keeping the hands dry, and blotting the face and brow of perspiration; said article including:

(a) a first, central region defining the primary moisture absorbent portion of said article; said first, central region being formed of a knit stitch construction having the characteristics of softness and absorbency; and further including a tubular length in the range of three to six inches and a circumference sufficient to provide a loose fit relative to and around the wrist;

(b) second and third regions defining welt portions integrally knit on each walewise end of said central region; each of said welt portions being formed of a knit stitch construction which facilitates the selective application of an ornamental design or indicia thereto;

(c) each of said welt portions having a substantially shortened length, relative to said central region, and a circumference providing for a snug fit relative to said central region around the wrist and lower arm of the wearer;

said article being worn around the wrist in such a way that said first central region fits loosely extended around the wrist and lower arm, held securely in place by said welt portions during play.

2. A tubular, towel-like article according to claim 1 wherein said central region is formed of a terry-knit construction and said welt portions are formed of a plain knit construction.

3. A tubular, towel-like article according to claim 2 wherein at least one of said welt portions includes an ornamental design or indicia thereon.

4. A tubular, towel-like article according to claim 2 wherein said welt portions are formed of a double-thickness of knitted material.

5. A tubular, towel-like article according to claim 2 wherein said central region is formed of a first, cotton yarn and said welts are formed of said first cotton yarn with a second, elastic yarn added in prescribed courses.

6. A tubular, towel-like article according to claim 3 wherein said welt portions are formed by knitting a prescribed tubular length, folding said welt in half and stitching the two halves together to form said double-thickness.

7. A tubular, towel-like article according to claim 5 wherein said secondary yarn is nylon.

8. A tubular, towel-like article according to claim 5 wherein said secondary yarn is acrylic.

9. A method of making a stretch knit, tubular article adapted to be worn around the wrist during participation in a variety of different sports and used for keeping hands dry in towel-like fashion for blotting the face and brow of perspiration; said method comprising the steps of:

(a) knitting a first welt having a length in the range of 30 to 35 courses, using a first knit stitch of a type which facilitates the application to or knitting in of an ornamental design and which has a characteristic stretchability causing said welt to fit close to the wrist;

(b) knitting a main body portion integrally to said first welt and having a length in the range of 60 to 70 courses, using a second knit stitch which produces a fabric having the characteristics of softness, increased bulk and absorbency;

(c) knitting a second welt integral to said body portion substantially equivalent in length to that of said first welt and utilizing said first knit stitch;

(d) turning the terminal one-half of each welt inwardly to form a double-layer welt, and stitching each terminal end in place.

10. A method according to claim 9 further including the step of applying an ornamental design in at least one of said welts, said application being in a color contrasting with that of said welt.

11. A method according to claim 9 wherein said first knit stitch is a plain stitch and said second knit stitch is a terry stitch.

12. A method according to claim 9 wherein the steps of knitting said first and second welts further includes the addition of a selected elastic yarn knitted in a prescribed plurality of courses.

13. A method according to claim 9 wherein each of said steps of knitting said tubular article are carried out utilizing a cotton yarn.

14. A method according to claim 13 wherein each of said steps (a) and (c) for knitting said first and second welts utilizes a cotton and synthetic blended yarn.

* * * * *